United States Patent [19]

Shields

[11] Patent Number: 4,822,034

[45] Date of Patent: Apr. 18, 1989

[54] BARBELL SYSTEM

[76] Inventor: William D. Shields, 3031 Dalehurst Dr. W., Jacksonville, Fla. 32211

[21] Appl. No.: 208,173

[22] Filed: Jun. 17, 1988

[51] Int. Cl.[4] ..... A63B 13/00

[52] U.S. Cl. ..... 272/123; 272/118

[58] Field of Search ..... 272/117, 118, 122, 123, 272/134, DIG. 4; 294/15

[56] References Cited

U.S. PATENT DOCUMENTS

| | | | |
|---|---|---|---|
| Re. 31,113 | 12/1982 | Cokler et al. | 272/118 |
| 1,779,594 | 10/1930 | Hall | 272/123 |
| 3,257,111 | 6/1966 | Martin | 272/118 |
| 3,346,256 | 10/1967 | White | 272/118 |
| 3,612,523 | 10/1971 | Glynn | 272/118 |
| 3,746,338 | 7/1973 | Proctor | 272/118 |
| 3,771,785 | 11/1973 | Spetier | 272/123 |
| 4,361,323 | 11/1982 | Slegersten | 272/118 |
| 4,529,198 | 7/1985 | Hettick, Jr. | 272/123 |
| 4,564,194 | 1/1986 | Dawson | 272/118 X |

FOREIGN PATENT DOCUMENTS

| | | | |
|---|---|---|---|
| 3300073 | 7/1984 | Fed. Rep. of Germany | 272/118 |
| 1085602 | 4/1984 | U.S.S.R. | 272/118 |

*Primary Examiner*—Richard J. Apley
*Assistant Examiner*—Richard J. Bahr

[57] ABSTRACT

A barbell weight lifting apparatus comprising a plurality of spaced weights stored on spaced apart support trays and arranged in two horizontal rows on a frame, the weights each having an identically positioned horizontal slot therein and a vertically disposed pin mounted in therein for securing the weights to a lifting bar. The lifting bar has a rotatable collar on each end with spaced circumferential grooves cut therein in positions to be in line with the pins in the weights when the lifting bar is positioned in the slots. The lifting bar has round wheels attached to the ends thereof which rest in a guide channel on each end of the frame and cooperate with a pair of spaced alignment bar mounted on the frame for control of the motion of the lifting bar to maintain the lifting bar in proper alignment with the frame and the weights during weight loading and unloading procedures. Weights not selected for attachment to the lifting bar are prevented from movement off the frame by a horizontal safety bar. Two alternate embodiments of the weights used and the associated securing mechanism are provided. One weight utilizes a side-mounted pivotal lever for securing the weight to the bar. The rearward end of the lever is formed as a latch to engage the weight frame. The second alternate weight employs a side-mounted vertically slidable plate for a locking mechanism to attach the weight to the bar.

33 Claims, 7 Drawing Sheets

BARBELL SYSTEM

BACKGROUND OF THE INVENTION

1. Field of the Invention

The present invention pertains to weight-lifting apparatus and particularly to barbell systems employing freeweights.

2. Prior Art

Barbell weight-lifting apparatus normally consists of a bar and a plurality of discs of various weights with a central hole to permit the disc to slide onto the end of a bar where it is secured into place by collars. The selection of the appropriate weights and assemblage of those weights on the bar is a time consuming delay even with organized storage racks. One method of dealing with these problems is to incorporate the weights into a large machine using pulleys and the like (e.g., U.S. Pat. No. Re. 31,113, U.S. Pat. Nos. 3,746,338 and 4,361,323) or designing specially formed weights (e.g., U.S. Pat. No. 3,771,785) or employing complex securing systems as part of the weights, (e.g., U.S. Pat. No. 1,779,594). None of these prior art arrangements provides the desired facility of easy adjustment of weights and and yet retains the simplicity of a barbell device. Even improvements that provide rapid and automatically adjustable weight selection (e.g., U.S. Pat. No. 4,529,198) are expensive and provide only sequential weight selection, i.e., a user adds or subtracts weights from a series of weights arranged vertically or horizontally.

Safety is of utmost concern in handling "freeweights"—those weights not permanently affixed to a barbell or other apparatus—because single weights may fall on a user and freeweight systems often are used with great weightloading for body building and similar activities. Problems such as slippage of a securing collar can result in dangerous weight shifts. Accordingly, weight must be adequately secured to the barbell. Also, weights in weight-selectable systems should specifically provide that weights not selected remain stationary.

Specific disadvantages of machines that are overcome in the present invention include the fact that many machines limit movement to specific paths along tracks or within guides. In addition, machines often control velocity of movement or vary the resistance applied to a given movement and are thus not "natural" in their approach to exercising. Many machines are constructed to be used by some "average" size person and thus do not accommodate very short or very tall people. Furthermore, many machines are so specialized in nature with respect to a given exercise that it can be prohibitively expensive to buy several machines to get an effective workout even if adequate floor space is available. Finally, many machines are extremely expensive even for commercial spas. All of these disadvantages are overcome using a freeweight system in accord with the present invention.

Freeweight systems not only allow greater levels of weight to be placed on a bar than can be attained with many machine-dependent systems but also require a user to stabilize the weights when exercising rather than simply lift and release. Therefore the ability to place different weights at different locations on a bar provides for exercises that are simply not possible with systems known in the art. What is most desired is a barbell system that provides all the advantages of freeweights (e.g. greater weight and flexibility) and all the advantages of machine-dependent systems (e.g. safety and ease of use).

The improvements in accord with this invention substantially alleviates the aforementioned problems of the prior art and provides most if not all of the advantages of both barbell and machine type of weight systems.

SUMMARY OF THE INVENTION

In accordance with the present invention, a barbell weight lifting apparatus is provided comprising an elongated lifting bar, a plurality of planar weights adapted to be selectively attached to the bar, support means to position the weights upstanding in a horizontal row, selective means for detachably securing the weights to the bar. Each weight has an identically positioned horizontally disposed lateral slot therein extending from a generally upright edge of the weight to generally medially thereof and the bar is positionable through each slot at a respective weights and is selectively secured to the selected weights. The selective means includes a movable pin vertically mounted in each weight, the pin having a first position transversing slot forwardly of the bar for securing the lifting bar in the slot and a second position removed from the slot for allowing free movement of the lifting bar into and out of the slot. Each weight has a bottom edge, including a pad affixed to the bottom edge for reducing sliding friction when the weight is moved onto the support means. The apparatus further comprises a frame and the support means is mounted to it. The frame includes guide means for restricting the vertical movement of the bar while being moved in a lateral direction into and out of the slots in the weights. A pair of spaced round wheels are mounted on the lifting bar with the guide means including a pair of elongated spaced guide channels respectively extending along a side of an adjacent weight and connected to the frame, the wheels being disposable within a respective corresponding guide channel for locating the bar in horizontal alignment with all the slots of the weights. A pair of spaced sleeves is coaxially positioned around and rotatably mounted to the lifting bar adjacent respective ends thereof, the sleeves having a plurality of spaced grooves therein for receiving respective pins therethrough, each of the grooves being spaced to be in vertical alignment with the pin in a respective corresponding weight when the wheels are disposed in the corresponding channels and the sleeves are fully within the slots of the weights. A pair of spaced alignment bars is attached to the frame, with vertical portions positioned forwardly of the weight receiving trays such that when the lifting bar is moved rearwardly from an initial forward position with the wheels positioned away from the corresponding guide channels, the lifting bar engages the vertical portion when the wheels are positioned above the corresponding guide channels. The lifting bar is movable rearwardly below a horizontal portion of the alignment bars only when the guide means are disposed in the corresponding guide channels. Blocking means to prevent the movement of any weight not attached to the bar is also provided. Each of the weights includes a locking member and the blocking means includes a horizontal rod oriented to inhibit forward movement of the locking members extending above the weights when the locking members are in their upward nonselected position and the bar is moved forwardly with the selected weights thereon. A pin locking means is provided for securing the pin in the first or second position. The pin has a first and second vertically spaced circumferential groove and the pin locking means includes a spring-biased detent slidably mounted in the weight which is selectively positionable within the first groove for locking the pin in the first position and selectively positionable within the second groove for locking the pin in the second position. The support means includes a pair of spaced weight receiving trays affixed to the frame adjacent respective end portions of the bar. The weight receiving trays have a forward depending lip to permit forward pivotal motion to the selected weights during forward movement of the bar so that the weights move down the lips to remove any force on the pins and to place all the load of the selected weight onto the bar.

In accordance with another aspect of the present invention, the selective means includes a movable lever pivotally mounted on a side of the weight, the lever having a first position transversing the slot forwardly of the bar for securing the lifting bar in the slot and the weight to the bar and a second position removed from the slot for allowing free movement of the lifting bar into and out of the slot. The lever includes a forward portion and a rearward portion, the rearward portion having a downwardly disposed tab, the suppport means including a plurality of laterally spaced slots for selective engagement by the tabs of respective levers. A locking means secures the lever in the first or the second position, the lever having first and second spaced depressions by way of a spring-biased detent slidably mounted laterally in the weight. The detent is selectively positionable within the first depression for locking the lever in the first position and selectively positionable within the second depression for locking the lever in the second position. In this aspect of the invention, the sleeves have a plurality of spaced grooves therein for receiving respective levers therethrough, the grooves being spaced in vertical alignment with the lever on respective weight.

In a third aspect of the present invention, the selective means includes a flat plate slidably mounted on a side of the weight, the plate having a first position transversing the slot forwardly of the bar for securing its lifting bar in the slot and a second position removed from the slot for allowing free movement of the lifting bar into and out of the slot. This aspect includes a horizontal rod positioned above the weights and located to engage the top portion of the plate to inhibit any forward movement of an unselected weight during movement of the bar and a spring-biased detent for locking the plate in either of two positions in a manner similar to that discussed above.

In the first and third embodiments of the present invention the support means includes a plurality of spaced forwardly extending protrusions, each weight having a depression in the rearward edge portion thereof, the protrusion being located within the depression when the weights are positioned on the support means for inhibiting lateral movement of the weights.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
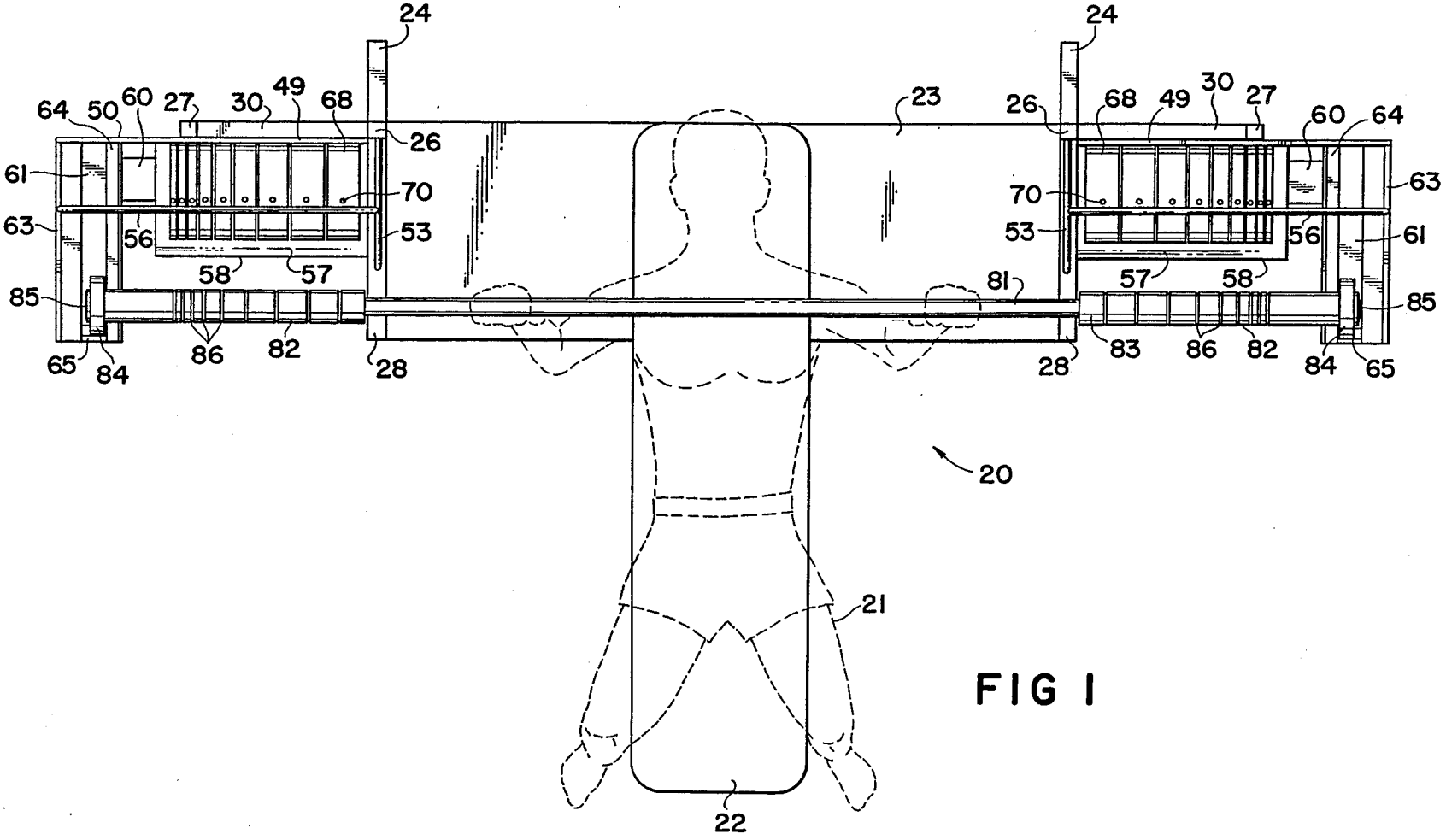
FIG. 1 is a top view of the barbell system in accord with the present invention used in a bench press configuration.
Figure 2:
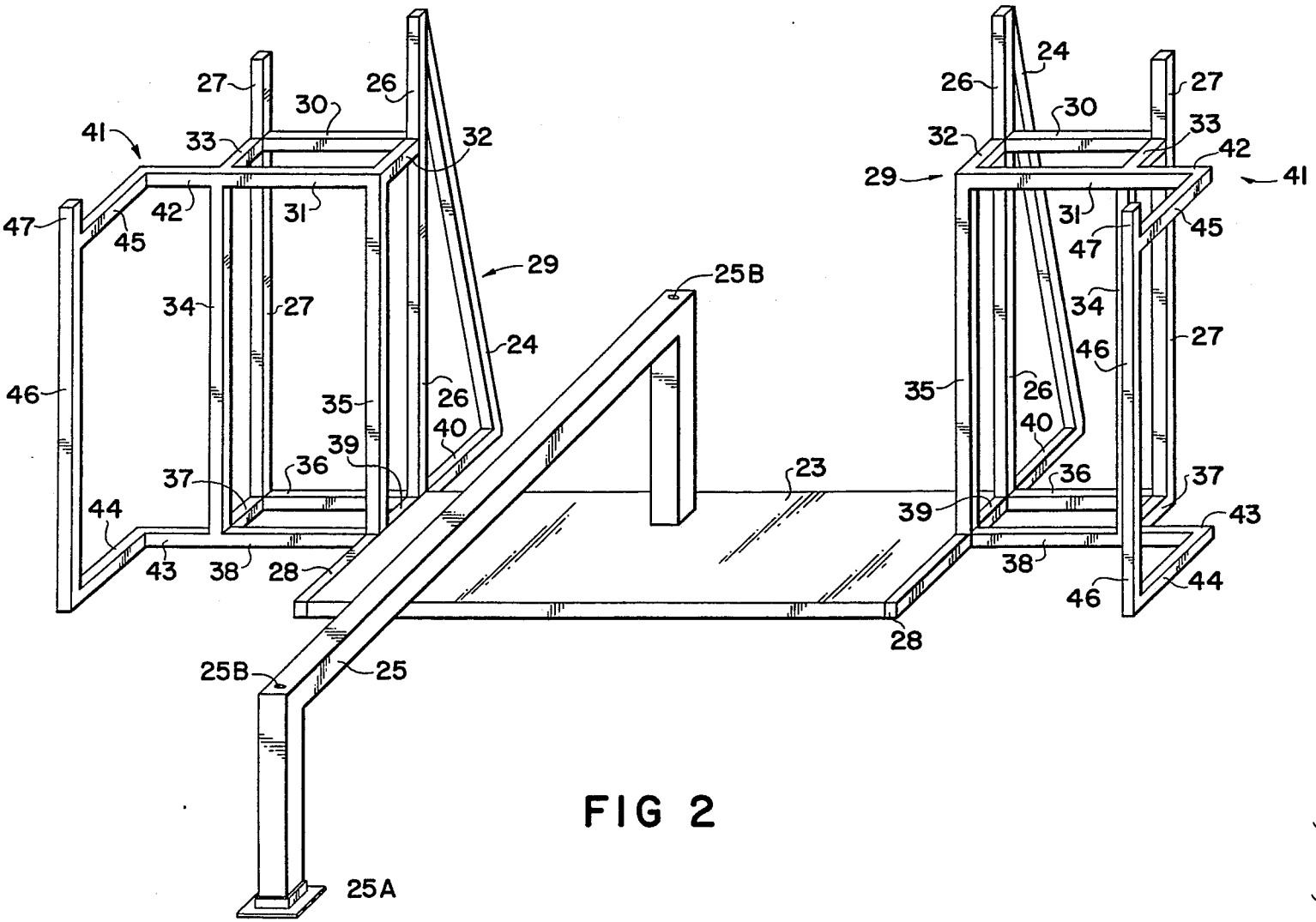
FIG. 2 is a perspective view of the main frame used in the invention illustrated in FIG. 1.

Referring now to FIGS. 1 and 2 the barbell system in accord with the present invention is depicted generally at 20. A weight-lifter 21 is positioned on a bench 22 which is mounted on a floor plate 23 at its forward end. A detailed illustration of the frame system used in the present invention is depicted in FIG. 2. General forward and rearward stability of the frame system is accomplished by having bench support frame member 25 extending forwardly and resting on a surface via mounting flange 25A to prevent marking or other damage to the underlying supporting surface. The bench support frame may be welded or bolted to floor plate 23 adjacent the rearward edge thereof. Angled rear frame struts 24 are welded to vertical inner frame posts 26 which are aligned with their vertical outer frame posts 27. Floor plate frame members 28 extend rearwardly to the lower outside end of angled rear frame struts 24 via sections 39 and 40 which are numbered separately only for purposes of description.

A weight support frame 29, on each side of the bench 22, consists of a rectangular section made of the upper rear member 30, upper forward member 31 and two spaced upper side members 32 and 33, all integrally joined and being joined to front outer and inner frame posts 34 and 35 and rear inner and outer frame posts 26 and 27. At the bottom, lower front and rear members 36 and 38 and lower side members 37 and 39 form an integral rectangle and are suitably welded to frame posts 26, 27, 34, and 35, as clearly shown in FIG. 2. Guide channel support frame 41 consists of an integral welded, lateral extension of weight support frame 29 having upper and lower extension members 42 and 43 welded to upper and lower weight support frame members 31 and 38 respectively. Two forward extensions 44 and 45 are welded to the ends of members 42 and 43 respectively. A vertical front post 46 with a vertical extension member 47 completes the guide channel support frame 41. As clearly shown in FIG. 2, there are two weight support frames 29 and guide channel support frames 41 that are mirror images of each other with respect to a longitudinal centerline passing through bench support frame 25.

As understood in the art, the various frame members described preferably are hollow box members to achieve a desired strength-to-weight ratio in a particular application and to reduce total system cost. The bench 22 is secured to bench support frame 25 via bolts or the like (not shown) integral to the bench which fit through spaced holes 25B. The illustrated preferred embodiment is a barbell system 20 configured and shown herein for the "bench press" exercise. The present invention, however, is not to be limited thereto but includes any free weight storage and selector system that can be used in many exercises and accordingly, the exact construction of the weight support frame 29 and guide channel support frame 41 will vary as the physical dimensions of the barbell system 20 vary with different exercise configurations.

Figure 3:
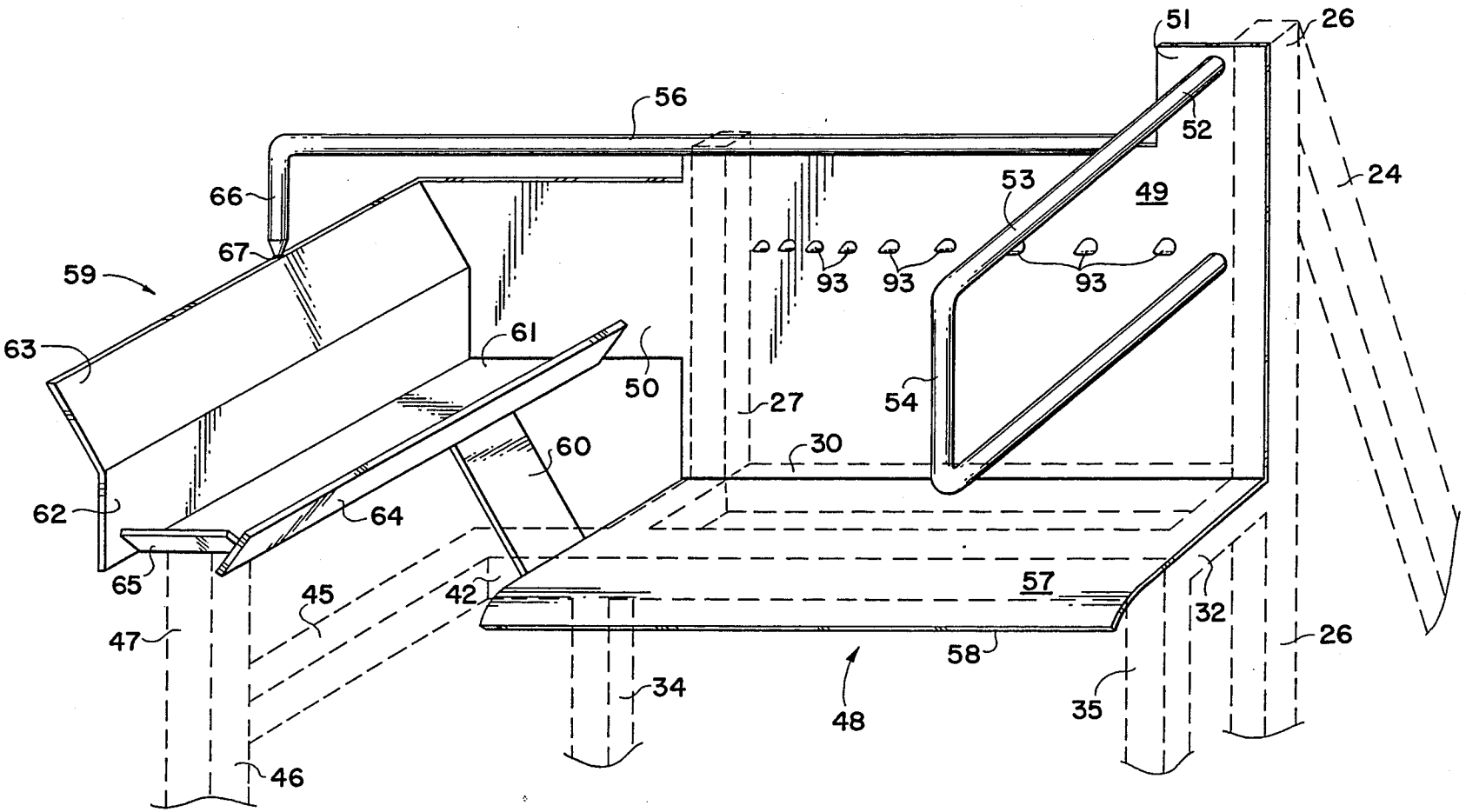
FIG. 3 is a perspective view illustrating the left end portion of the weight tray assembly and guide channel assembly used in the present invention, the right end portion being the mirror image thereof.

Referring now to FIG. 3, the weight tray assembly 48, in accord with this invention, is shown mounted on weight support frame 29 and includes rear wall 49 which has an integral lateral extension 50 and upright extension 51. The wall 49 is preferably welded to frame posts 26 and 27. A U-shaped alignment bar 52 is welded to rear wall 49 or it may be mounted through rear wall 49 and frame post 26 and secured by bolts or the like (not shown). Weight bearing support plate 57 is welded to rear wall 49 and has a downwardly angled leading edge 58. As will be more fully explained hereinbelow, alignment bar 52 is part of the means by which the movement and alignment of weights 68, used in the barbell system, are to be controlled. Alignment bar 52 has upper portion 53 and lower portion 55 of sufficient length to place forward portion 54 generally upright and preferably forward of the edge 58 of weight pad 57. One end of a safety weight stopping bar 56 is welded to upper portion 53 of alignment bar 52 with the other end 66 being welded at 67 to top portion 63 of guide channel 59. Guide channel 59 is mounted on the vertical extension member 47 of vertical front member 46 and is mounted against the outer edge of weight pad 57 via angled support strut 60. Guide channel 59 consists of bottom wall 61, outer wall 62 with outwardly angled top portion 63, inner angled wall 64 and end stop 65. If desired, other box members can be employed, for example, beneath bottom wall 61 with a vertical member supporting to the upper corner formed between members 42 and 45 and even to the bottom corner formed between members 43 and 44. Also, it is to be understood that safety bar 56 could be bent adjacent support 27 and be welded to back plate 49 and/or connected to 27 in a manner previously described in connection with alignment bar 52.

Figure 5:
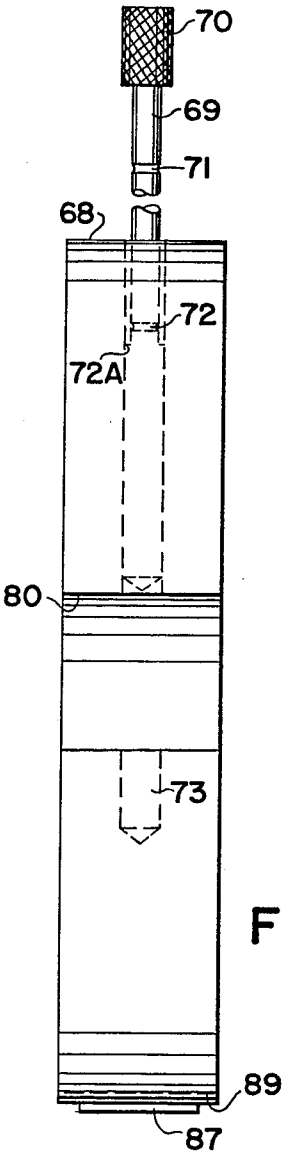
FIG. 5 is a front elevational view of the weight of FIG. 4 with the safety locking pin in the "open" position.
Figure 4:
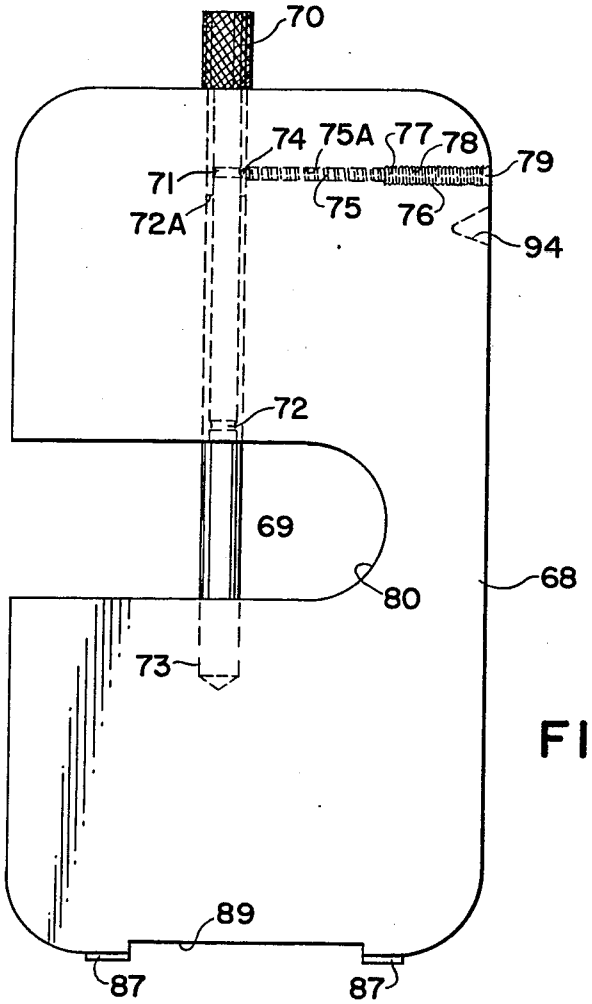
FIG. 4 is a right side elevational view of a weight used in the present invention with the safety locking pin in "locked" position.

FIGS. 4 and 5 illustrate the weights 68 used in the barbell system 20. Each weight 68 has the same general shape and has a front and bottom slightly heavier than the rest of the weight for balancing as will be discussed. A safety locking pin 69 has a knob 70 and an upper notch or groove 71 and lower notch or groove 72, such pin being slidably fitted into a generally vertical drilled passageway 73 in weight 68. The safety locking pin 69 is held in an upraised "unlocked" position as shown in FIG. 5 or a lower "locked" position (FIG. 4) by a ball or detent 74 that is forcibly biased into groove 71 or 72 by compression spring 75. The spring 75 is mounted in a generally horizontally drilled passageway 75A in weight 68 and secured into place by an Allen screw 76 having threads 77 which in turn engage threads 78 in passageway 79 enlarged and in alignment with passageway 75A, as clearly shown in FIG. 4. By grasping knob 70 the safety locking pin 69 can be readily moved between the locked or unlocked positions.

Figure 6:
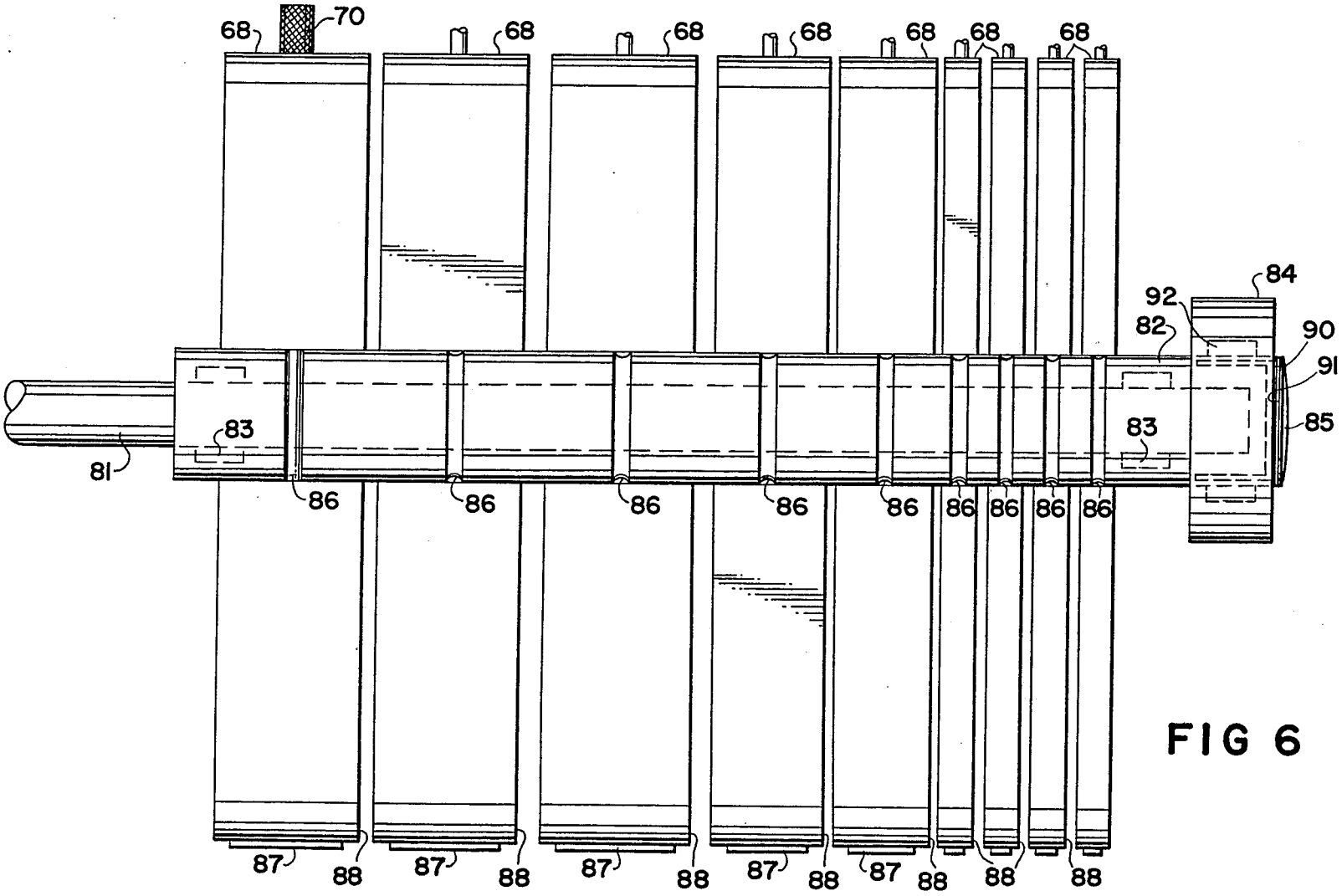
FIG. 6 is an enlarged front elevational view of the right end portion of the bar and selective weights used in accordance with the present invention.

Weights 68 have forwardly directed U-shaped slots 80 extending from the axis to the periphery to facilitate selecting thereof or not selecting which weights 68 will be engaged onto the bar 81 and used in a given exercise. FIG. 6 illustrates the bar 81 with a rotatable collar or sleeve 82 mounted thereon at each end and onto spaced bushings or bearings 83. Round guide wheels 84 are attached to the outer surface of each collar 82 via ball bearings 92 and secured in place via snap rings 90 which fits in collar grooves 91. Hub covers 85 are press-fitted into collar 82. Guide wheels 84 travel in each guide channel 59 on bottom wall 61. Different weights 68 may have a different thickness as illustrated in FIG. 6 with greater thickness resulting in greater weight. Other than different thicknesses, the weights have the same general shape as shown in FIGS. 4 and 5. Circumferential grooves 86 are cut out of each collar 82 at points in alignment with respective pins 69 with bar 81 in the stored position. As more clearly shown in FIG. 9, pin 69 will fit into the space of collar groove 86 when the bar 81 and sleeve 82 is pushed into the slot 80 in weight 68. If bar 81 is thereafter moved forwardly, those weights 68 having a pin 69 in the down or locked position are engaged and may be moved forwardly to a position to be lifted from weight pad 57. Those weights 68 with a pin 69 in the raised or unlocked position will not be engaged and, importantly, the up-raised knob 70 of the pin 69 will make contact with safety bar 56 to prevent any dislodging movement of that weight 68 beyond the point of contact. This feature prevents an otherwise not-selected weight 68 from being frictionally engaged by the collar 82 and/or adjacent selected weights 68 and being dragged off pad 57 and then falling onto the floor surface. Low friction spaced pads 87 are installed on the bottom of each of the weights 68 and when the bar 81 is returned to the stored position after a given exercise is completed, placement of round guide wheels 84 into guide channel 59 will result in the weights 68 being returned to their original position when the guide wheels 84 are used to enable the weighted bar 81 to be pushed into its at rest position shown in FIGS. 1 and 8.

Figure 9:
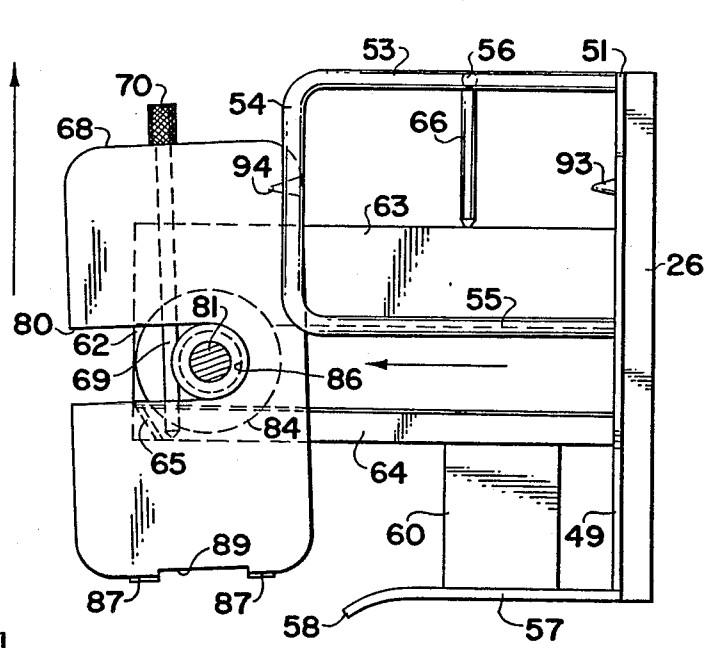
FIG. 9 illustrates the weights of FIG. 9 loaded onto the bar in position to be lifted off of the guide channels.

As illustrated in FIG. 9, when a weight 68 is secured to bar 81 via pin 69 and collar groove 86, the weight 68 is supported only by the sleeve 82 and not by pin 69. The balance of the weight 68 provides this positioning for reasons of safety in operation. The weights 68 will rotate forward when they move off edge 58. In addition, weights 68 are held in relative horizontal position with pin 69 in collar groove 86 and accordingly dangerous shifting of weight to one side is not possible.

Figure 8:
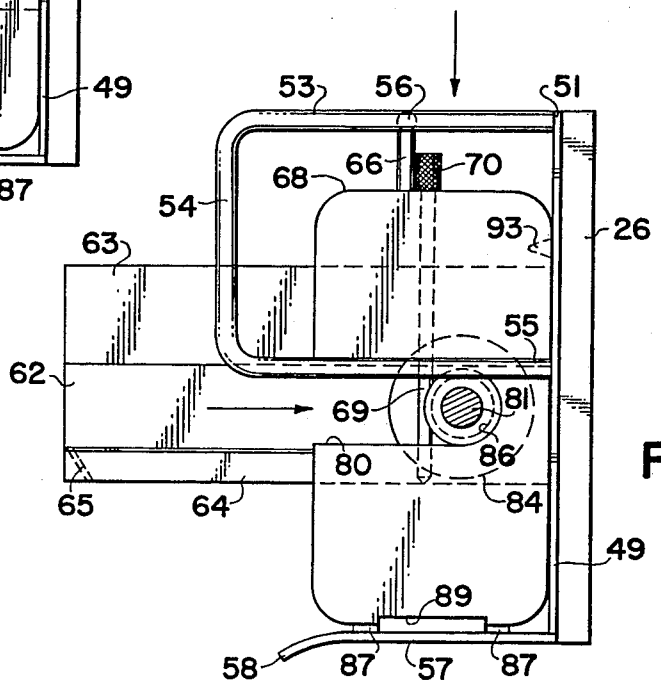
FIG. 8 illustrates the weights of FIG. 8 locked onto the bar.
Figure 7:
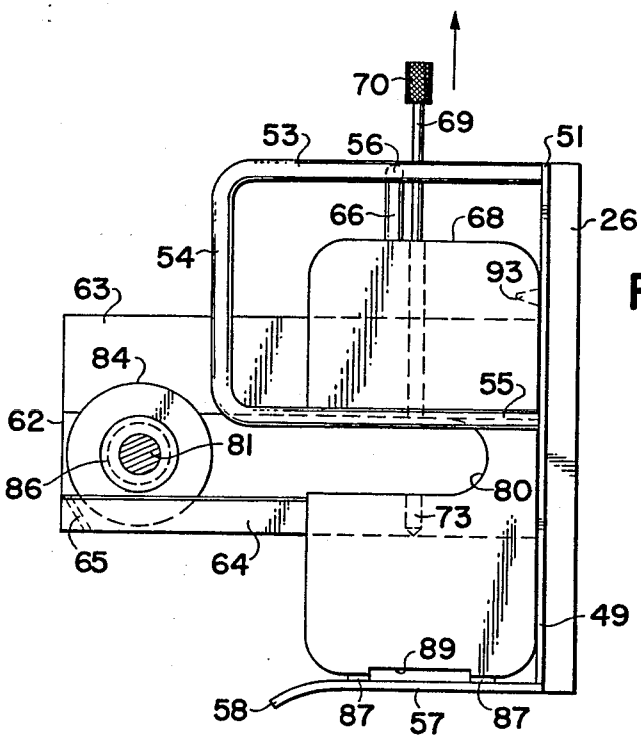
FIG. 7 is a right side elevational view of the left weight tray assembly of FIG. 3 illustrating the relative position of the weights and bar before any of the weights are secured to the bar.

With reference again to FIGS. 1 and 7–9, a description of the operation of the barbell system 20 will be helpful in understanding the unique features thereof. A user 21 prepares for a given exercise by horizontally moving bar 81 into slots 80 of weights 68 after first pulling all the pins 69 to their unlocked position as shown in FIG. 7. The user 21 can then select which weights 68 are to be used by simply pushing down on the associated knob 70 to force locking pin 69 into the engaged position (FIG. 8). The pin 69 fits laterally into respective groove 86 to lock the weight onto the sleeve 82 and bar 81. The user 21 can then get into position on bench 22 (FIG. 1) and grasp bar 81. The bar 81 is moved forward toward the ends of bottom walls 61 pulling weights 68 forward on weight support plate 57 and off leading edge 58 thereof. The weights 68 are balanced to rotate the weights 68 to directly place all of the force on sleeve 82 and bar 81 and not on pin 69. The bar 81 is then lifted over end stops 65 of guide channels 59. The weighted bar 81 can now be used for whatever exercise is desired including exercises independent of bench 22. As illustrated in FIG. 6, a small space 88 exists between adjacent weights 68 to prevent frictional engagement of weights 68 attached to the bar 81 from contacting and dragging along weights 68 that were not selected. To insure that this does not happen, safety bars 56 will engage all upraised pin 69 of any weight 68 not selected.

When a given exercise has been completed and/or the weight 68 selection is to be changed, the bar 81 is returned to its position of FIG. 8 by placing guidance wheels 84 onto guide channel bottom walls 61 and pushing the bar 81 rearwardly. A user 21 is provided indication that bar 81 can be lowered and set down safely by contact between the bar 81 and alignment bar member 54. As also shown in FIG. 1, the collars 82 are positioned outwardly of the plane of alignment bars 52 when guide wheels 84 are positioned vertically over the bottom walls 61 of guide channels. Accordingly, when the bar 81 touches both members 54, the guide wheels 84 are in alignment with guide channels 59 and the user 21 can set the bar 81 down by placing guide wheels 84 into the guide channels 59. In addition, the collars 82 have a larger diameter than bar 81 and the user 21 is provided with a visual indication of the position and alignment of the bar 81 with respect to guide channels 59, so that the bar 81 can be set down safely and moved rearwardly to position weights 68 on weight bearing support plate 57. Finally, alignment bar 52 restricts vertical movement of lifting bar 81 prior to the bar 81 being moved forwardly past the leading edge 58 of weight bearing support plate 57. This feature prevents vertical movement of the bar 81 until the weights 68 have cleared safety bar 56 and thus vertical movement of unselected weights is not possible. Because of the alignment of guidance wheels 84 and guide channel 59, the weights 68 on the bar 81 can be pushed into their original position with the assistance of low-friction pads 87 on the bottom of each weight 68.

Safety bar 56 in conjunction with spaces 88 works to prevent movement of weights 68 that were not selected for a given exercise. Pins 93 protrude forwardly from rearwall 49 and fit within slots 94 to provide lateral stabilization of the weights 68 when they are in the stored position. In the event that one desired, small spacer members can be provided along support plate 57 and/or rear plate 49 so that the remaining weights 68 on support plate 57 will not shift in any manner. It is to be understood that such spacers would be of a width less than space 88 to minimize any frictional resistance between weights 68 and such spacers during removal or return of weights 68 from or to weight tray 48.

The unique features of the barbell system 20 include the selectable freeweight arrangement wherein a given weight 68 can be selected and any particular combination of weights 68 can be selected because the weights 68 are arranged horizontally instead of vertically. Conventional vertical weight arrangements allow a person only to add or subtract from a stack of weights 68 whereas the present system 20 allows any number of arrangements of individual weights 68 to be selected as appropriate to a given exercise. Each weight 68 has an individual pin 69 and accordingly, weights 68 need not be moved in order to load or unload the sleeve 82 and bar 81. This feature not only saves time but avoids the inconvenience of a gym owner having to remove very heavy weights from a bar to accommodate a user who may have difficulty simply removing the weights from a given barbell. The shape of the slots 80 is also a necessary part of the present invention in that it allows for the horizontal movement of the bar 81 into weights 68 to permit this ready selecting arrangement. Also, the center of the bar 81 is offset rearwardly from the geometric center of the weight so as to accommodate for the slot in the forward portion of the weight. In this connection the offset can be exaggerated rearwardly and upwardly from its truly balanced condition to make certain that the weight 68 will rotate counterclockwise, as shown in FIG. 9, to relieve any force on pin 69.

It can be seen that no additional storage area is required for the weights 68 as they simply remain at rest on the weight support plate 57 when not in use. In addition, the weights 68 vary only in thickness and are easier to manufacture but may be manufactured out of different materials with their size being the same. Of course, the weights will have proper indication on the top and front edges so that the user will know what is selected. The horizontal weight tray 57 arrangement keeps the weights 68 spacedly away and removed from the area of the user 21 and maintains same in an orderly fashion.

The use of grooves 86 in sleeve 82 provides stability for the weights 68 when on the bar 81 while rotatable sleeve 82 allows a user 21 to adjust the movement of the bar 81 to achieve the desired handhold. The balance of the weights 68 provides that all the force of the weights 68 is on the sleeve 82 and bar 81 and not on pin 69. The shape of the bottom of weights 68 and low-friction pads 87 thereon provide ease of movement of the weights 68 on and off weight support plate 57. The use of guide channel 59 and alignment pins 93 maintains the weights 68 in their proper location. In summary, the barbell system 20 is self-aligning and very safe in operation as safety bar 56 provides an additional means to prevent inadvertent movement of unselected weights 68.

Each weight 68 is 0.5%–2% heavier in front than in rear. This can be accomplished via the asymmetrical location of the interior end of slot 80 with respect to the side profile centerline or by whatever other means are appropriate. The bottom of the weight is also heavier than the top and thus the locking pin 69 is always located upwardly during all movement of the bar 81 by the user, for example, in arm or wrist curls or the like due to the free rotation of sleeve 82 on bar 81 and gravity acting on weights 68.

Cut out portion 89, as shown in FIG. 4, is fabricated in the weight 68 to prevent the bottom of the weight 68 from dragging on weight support plate 57 thus placing all the weight on low-friction pads 87 for ease of movement of the weight loaded bar 81.

The guide wheels 84 are mounted on the outboard ends of bar 81 and travel in guide channels 61 which are also positioned on the outboard ends of the weight tray. The frame could be reconfigured to place the guide channel support frame 41 and the guide channels a points intermediate the length of bar 81 and adjacent the alignment bars 52. This arrangement may be used in barbell systems employing great weight such as that used in leg exercises or squats and provides rapid and safe release of a weighted bar 81 if the user 21 so desires.

Pin 72 may be larger at the lower portion thereof and have a larger diameter hole 73 at the lower end thereof with lip 72A to prevent complete removal of pin 72 from weight 68. This arrangement or similar arrangements can be built into the weight 68 to prevent a pin 72 from being lost.

Figure 10:
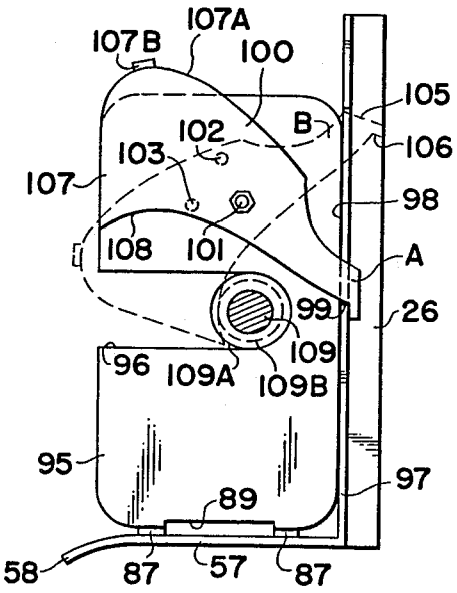
FIG. 10 is a right side elevational view of a second embodiment of a weight used in the present invention.
Figure 11:
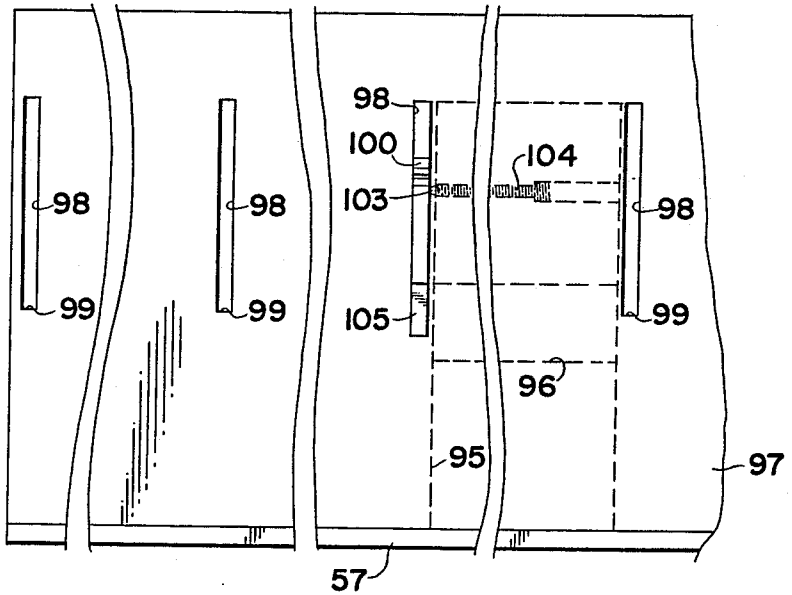
FIG. 11 is a rear elevational view of the weight tray assembly used with the weights of FIG. 10.

The preferred embodiment of the weight and locking apparatus is illustrated in FIGS. 10 and 11. The weight 95 has the same general shape as weights 68 including the horizontal disposed slot 96. Rear wall 97 is the same as that described previously with the exception of a plurality of vertically disposed slots 98. The slots 98 have a lower edge 99 that functions as a shoulder or latch lip, hereinafter more fully described.

Lever 100 is used as the selective locking device and is pivotally mounted to the side of weight 95 via bolt 101. The lever 100 has two spaced depressions or holes that can be engaged by spring-loaded detent 104, which is somewhat similar to detent 74 as previously described. Lever 100 has an upper rearward portion 105 with a latch tab 106 and a lower forward portion 107 with a curved engaging surface 108. Forward portion 107 of the lever 100 is formed to provide a roughly hemispherical portion 107A which extends above the upper surface of weight 95. A knob or projection 107B may extend laterally over the weight so that it can be readily engaged by the user 21 to move the lever 100 between the full line unlocked position A and its broken line unlocked postion B with respect to the sleeve 109A. In postion A, lever 100 is moved to position latch tab 100 over and in back of latch up 99 to prevent forward movement of weight 95. In position B, the lever 100 is moved to position curved engaging face 108 into groove 109B in sleeve 109A. The sleeve 109A is rotatably mounted on lifting bar 109, just like sleeve 82 is mounted on bar 81, as previously described. The grooves 109B are offset from the plane of the weights 95 in a space between adjacent weights. Engaging surface 108 is preferably curved as illustrated to conform substantially to the arc of groove 109B, but may be straight without departing from the invention disclosed herein.

The advantages of this preferred embodiment include the omission of stabilizer alignment pins 93 and slots 94 and safety bar 56 which provides cost savings with no reduction in ease of use or safety. Also, the costs of fabrication of the weight 95 is less because the latching lever 100 is externally mounted and the detent 104 is positioned laterally rather than rearwardly from the rear edge of the weight. While slot 98 is shown as being closed at the top, it is understood that the slot 98 may extend to the upper edge of rear wall 97, if desired.

The weights 95 used in the preferred embodiment are also balanced to provide a slight forward tilting when they are moved forwardly off edge 58 of weight tray 57. Also, low friction pads , identical to pads 87, may be affixed to the weights 95 if desired. As with the first embodiment discussed above, the guide wheels 84 used in the preferred embodiment may be employed inside the weight trays 57, or outwardly thereof or such guide wheels and corresponding channels may be employed on both sides of the weight trays 57.

Figure 12:
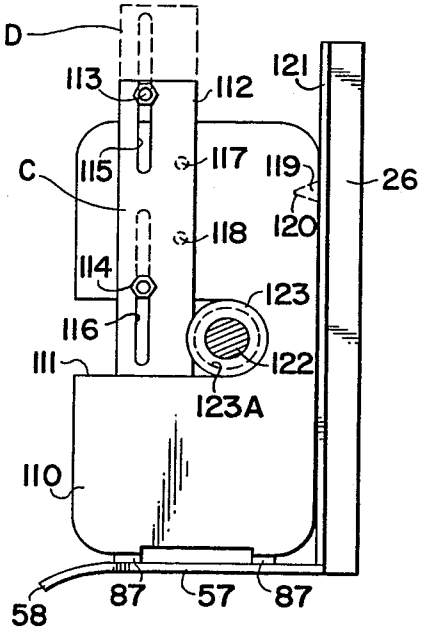
FIG. 12 is a right side elevational view of a third embodiment of a weight used in the present invention.

A third embodiment of the weight and selecting means according to the invention is illustrated in FIG. 12. A weight 110 has a forward slot 111 and is similar in size and shape to the weights 68 and 95 previously described, the selective locking apparatus includes a slidable flat plate 112 that is mounted to one side of the weight 110 via headed bolts 113 and 114 which fit within elongated positioning slots 115 and 116 respectively. This arrangement provides for properly aligning the plate 112 with respect to a spring-loaded detent (not shown), but identical to detent 104. In full line position C, the detent fits with a depression or hole 117 on the interior side of plate 112 thereby locking the plate 112 downwardly and within the groove 23A of sleeve 123 and allowing the weight 110 to be moved by lifting bar 122.

In brokenline postion D, the detent fits within depression or hole 118 thereby locking plate 112 in an upward position allowing free movement of the bar 122 into and out of the slot 111. The weight 110 will remain in position because any frictional forces at work to drag the unselected weight 110 forward will be blocked by the upper portion of plate 112 coming into contact with a safety bar 56 which would be positioned forward of the position of bar 56 illustrated in FIGS. 7–9. In addition, an alignment pin or similar protuberance 119 mounted on rear wall 121 fits within a slot or depression 120 in weight 110 for lateral stabilization of the weight 110.

Figure 13:
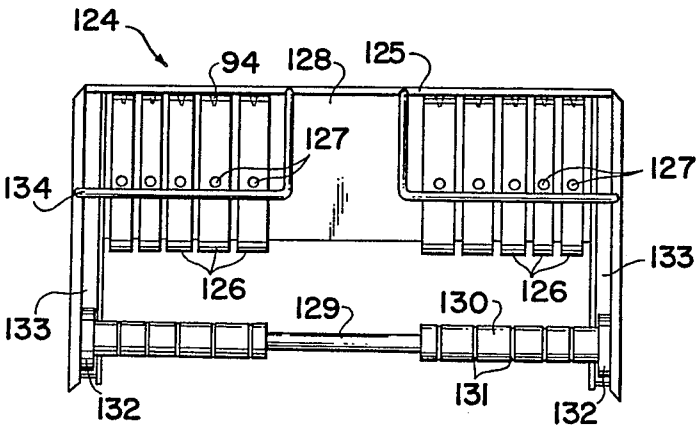
FIG. 13 is a top view of the barbell system in accord with the present invention used as a one-hand dumbbell.

In FIG. 13, a smaller version of the barbel invention is illustrated for use as a one-hand dumbbell system 124. The system 124 includes a rear wall 125 and two identical sets of weights 126 resting on a weight tray 128. Safety locking pins 127 may be substantially identical to pins 70 or either of the externally side mounted latches may be employed. A barbell 129 has two spaced sleeves 130 with grooves 131 in alignment with pins 127. This particular arrangement utilizes two ball bearing supported wheels 132 which travel in guide channels 133. Safety bar 134 may be used to engage upraised pins 127 in the manner previously described or bar 134 can be omitted in one-hand smaller weight systems where the safety feature is not as important as with other larger weight configurations. Also, pins 93 and depressions 94 may be used for lateral stabilization of the weights 126 in a manner as that previously described.

In the specific embodiment of the weights described herein, it is seen that the narrow depth and long height of the weights provide not only for a more compact overall unit requiring less floor space and/or storage, but also permits the user the shortest distance of travel of the bar with selected weights to clear the tray and for the user to begin his exercise routine.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a barbell weight lifting apparatus comprising an elongated lifting bar, a plurality of planar weights adapted to be selectively attached to said bar, support means to position said weights upstanding in a horizontal row, selective means for detachably securing said weights to said bar, each said weight having an identically positioned horizontally disposed lateral slot therein extending from a generally upright edge of said weight to generally medially thereof, said bar being positionable through each said slot at respective said weights and being selectively secured to selective said weights.

2. In the apparatus as defined in claim 1 wherein said selective means includes a movable pin vertically mounted in each said weight, said pin having a first position transversing said slot forwardly of said bar for securing said lifting bar in said slot and a second position removed from said slot for allowing free movement of said lifting bar into and out of said slot.

3. In the apparatus as defined in claim 2 further including a pin locking means for securing said pin in said first or said second position, said pin having a first and second vertically spaced circumferential groove, said pin locking means including a spring-biased detent slidably mounted in said weight, said detent being selectively positionable within said first groove for locking said pin in said first position and selectively positionable within said second groove for locking said pin in said second position.

4. In the apparatus as defined in claim 1 wherein each of said weights includes a bottom edge, said apparatus further including a pad affixed to said bottom edge for reducing sliding friction when said weight is moved onto said support means.

5. In the apparatus as defined in claim 1 further comprising a frame, said support means being mounted to said frame, said frame including guide means for restricting the vertical movement of said bar while being moved in a lateral direction into and out of said slots of said weights.

6. In the apparatus as defined in claim 5 further comprising a pair of spaced round wheels respectively mounted on said lifting bar, said guide means including a pair of elongated spaced guide channels respectively extending along a side of an adjacent said weight and connected to said frame, said wheels being disposable within respective said corresponding guide channel for locating said bar in horizontal alignment with all said slots of said weights.

7. In the apparatus as defined in claim 6 further comprising a pair of spaced sleeves coaxially positioned around and rotatably mounted to said lifting bar adjacent respective ends thereof, said sleeves having a plurality of spaced grooves therein for receiving respective said pins therethrough, each of said grooves being spaced to be in vertical alignment with said pin in respective said corresponding weight when said wheels are disposed in said corresponding channels and said sleeves are fully within said slots of said weights.

8. In the apparatus of claim 6 wherein said guide means includes a pair of spaced alignment bars attached to said frame, each said alignment bar comprising a forward vertical portion and a rearwardly extending horizontal portion affixed to the bottom of said vertical portion, said vertical portions positioned forwardly of said weight receiving trays such that when said lifting bar is moved rearwardly from an initial forward position with said wheels positioned away from said corresponding guide channels, said lifting bar engages said vertical portion when said wheels are positioned above said corresponding guide channels, said lifting bar movable rearwardly below said horizontal portion only when said guide means are disposed in corresponding said guide channels.

9. In the barbell weight lifting apparatus as defined in claim 6 wherein said support means includes a pair of spaced weight receiving trays affixed to said frame adjacent respective end portions of said bar.

10. In the apparatus as defined in claim 9 further including a pair of spaced alignment bars mounted on said frame and extending forwardly of said weight receiving trays, said alignment bars being positioned slightly above said lifting bar when said wheels are disposed rearwardly in corresponding guide means to prevent the vertical movement of said lifting bar when said selected weights are supported on said corresponding weight receiving trays.

11. In the apparatus as defined in claim 10 wherein said alignment bars are positioned slightly below said sleeves to prevent positioning of a said sleeves beneath said alignment bars so that said selected weights on said respective weight receiving tray are guided into their respective proper locations which are the same as when said weights were initially secured to said sleeves.

12. In the apparatus as defined in claim 9 wherein said weight receiving trays have a forward depending lip to permit forward pivotal motion to said selected weights during forward movement of said bar so that said weights move down said lips to remove any force on said pins and to place all the load of said selected weight onto said bar, said wheels being in corresponding said guide means during said forward movement of said bar prior to lifting thereof.

13. In the apparatus as defined in claim 9 wherein said weight receiving trays include a forward edge, said channels extending forwardly of said edge to allow said selected weights to be removed from said weight receiving trays when said lifting bar is moved forwardly without removing said round wheels from said corresponding channels, said frame further including stop means for selective engagement of said weights unattached to said lifting bar for inhibiting inadvertent movement of said weights on said weight receiving tray when said lifting bar is moved forwardly with any attached said weights, said stop means positioned rearwardly of said forward edge to engage said unattached weights with said wheels disposed in said corresponding channels.

14. In the apparatus as defined in claim 5 wherein said frame further includes blocking means to prevent the movement of any said weight not attached to said bar.

15. The apparatus as defined in claim 14 wherein each of said weights include a locking member, said blocking means includes a horizontal rod oriented to inhibit forward movement of said locking members extending above said weights when said locking members are in their upward unlocked position and said bar is moved forwardly with the selected weights thereon.

16. In the apparatus as defined in claim 1 wherein said selective means includes a movable lever pivotally mounted on a side of said weight, said lever having a first position transversing said slot forwardly of said bar for securing said lifting bar in said slot and said weight to said bar and a second position removed from said slot for allowing free movement of said lifting bar into and out of said slot.

17. In the apparatus as defined in claim 16 wherein said lever includes a forward portion and a rearward portion, said rearward portion having a downwardly disposed tab, said support means including a plurality of laterally spaced slots for selective engagement by said tabs of respective said levers.

18. In the apparatus as defined in claim 16 wherein said support means includes means to engage said lever when said lever is in said second position to prevent movement of said weight.

19. In the apparatus as defined in claim 18 further including a locking means securing said lever in said first or said second position, said lever having first and second spaced depressions, said locking means including a spring-biased detent slidably mounted laterally in said weight, said detent being selectively positionable within said first depression for locking said lever in said first position and selectively positionable within said second depression for locking said lever in said second position.

20. In the apparatus as defined in claim 19 further comprising a pair of spaced round wheels mounted on said lifting bar, guide means including a pair of spaced guide channels, said wheels being disposable within said corresponding guide channel for locating said bar in horizontal alignment with all said slots of said weights, a pair of spaced sleeves coaxially positioned around said lifting bar, said sleeves having a plurality of spaced grooves therein for receiving respective levers therethrough, each of said grooves being spaced in vertical alignment with said lever on respective said corresponding weight when said wheels are disposed in said corresponding channels and said sleeves are fully within said slots of said weights.

21. In the apparatus as defined in claim 20 further comprising stop means for selective engagement of said weights unattached to said lifting bar for inhibiting inadvertent forward movement of said weights on said weight receiving tray when said lifting bar is moved forwardly with any attached said weights.

22. In the apparatus as defined in claim 1 wherein said support means includes a plurality of spaced forwardly extending protrusions, each said weight having a depression in the rearward edge portion thereof, said protrusion being located within said depression when said weights are positioned on said support means for inhibiting lateral movement of said weights.

23. In the apparatus as defined in claim 1 wherein said selective means includes a flat plate slidably mounted on a side of said weight, said plate having a first position transversing said slot forwardly of said bar for securing said lifting bar in said slot and a second position removed from said slot for allowing free movement of said lifting bar into and out of said slot.

24. In the apparatus as defined in claim 23 wherein each said plate has a top portion extending vertically above said weight when said plate is in said second position, said support means including a horizontal rod positioned above said weights and located to engage said top portion of said plate when said plate is in said second position to inhibit any forward movement of said weight during movement of said bar and any selected weights attached thereto.

25. In the apparatus as defined in claim 23 further including a locking means securing said plate in said first and said second position, said plate having a first and second spaced depression, said locking means including a spring-biased detent slidably mounted in said weight, said detent being selectively positionable within said first depression for locking said plate in said first position and selectively positionable within said second depression for locking said plate in said second position.

26. In the apparatus as defined in claim 25 further comprising a pair of spaced round wheels mounted on said lifting bar, guide means including a pair of spaced guide channels, said wheels being disposable within said corresponding guide channel for locating said bar in horizontal alignment with all said slots in said weights, a pair of spaced sleeves coaxially positioned around said lifting bar, said sleeves having a plurality of spaced grooves therein for receiving respective plate therethrough, each of said grooves being spaced in vertical alignment with said plate on respective said corresponding weight when said wheels are disposed in said corresponding channels and said sleeves are fully within said slots of said weights.

27. In the apparatus as defined in claim 1 further comprising a pair of spaced sleeves coaxially positioned around and rotatably mounted to said lifting bar adjacent respective ends thereof, each said weight being heavier in front than in the rear so that said selective means remains above said bar during movement of said bar by a user thereof.

28. In the apparatus as defined in claim 27 wherein said bar has a longitudinal axis which is located above and to the rear of centers of gravity of respective said weights when attached to said bar.

29. In the apparatus as defined in claim 1 wherein said weights have a predetermined depth and a height generally twice the depth thereof so that said selected weights may be moved off said support means with minimal forward movement of said bar to readily enable a user to begin an exercise routine, said minimal forward movement being sufficient so that said bar clears unattached said weights supported by said support means.

30. In weight lifting apparatus comprising an elongated lifting bar having guide means at each end thereof, a plurality of plate-like, generally rectangular weights each having an identically positioned horizontally disposed radial slot therein, each said slot extending from an edge of said weight to generally its medial portion, a frame having two spaced weight receiving trays for storing a plurality of said weights standing on its bottom edge and arranged in a horizontal row thereon adjacent each end portion of said bar, said frame having two spaced elongated guide channels extending alongside of respective said tray, each said guide means being removably seated in said corresponding guide channel for aligning said lifting bar with respect to said slots of all said weights, said bar being positionable through each said slot at respective said weights, and means for selectively attaching said weights to said lifting bar.

31. In the apparatus as defined in claim 30 wherein said means for selectively attaching said weights to said bar includes a movable member mounted to each of said weights, each said member having a first position wherein said member is downwardly disposed transversing said slot of its respective said weight for securing said lifting bar in said slot and a second position wherein said member is disposed away from said slot for allowing free movement of said bar into and out of said slot.

32. In the apparatus as defined in claim 31 wherein said means for selectively attaching further includes a rotatable sleeve mounted adjacent each said end portion of said lifting bar, each said sleeve having a plurality of spaced grooves, said member being located at least partially in corresponding said groove when said member is disposed across said slot in said first position.

33. In the apparatus as defined in claim 32 wherein each said guide means includes a wheel, said weights being arranged in said weight receiving trays so that said members are vertically aligned with said corresponding grooves when said wheels are seated in said corresponding guide channel and said sleeves are positioned fully into said slots, said members being selectively movable into said second position by depressing said members.

* * * * *